US007243919B2

(12) United States Patent
Ringuette

(10) Patent No.: US 7,243,919 B2
(45) Date of Patent: Jul. 17, 2007

(54) CARD GAME

(75) Inventor: Brian Ringuette, 33 Allan Ave., Sudbury, MA (US) 01776

(73) Assignee: Brian Ringuette, Sudbury, MA (US)

( * ) Notice: Subject to any disclaimer, the term of this patent is extended or adjusted under 35 U.S.C. 154(b) by 84 days.

(21) Appl. No.: 10/894,632

(22) Filed: Jul. 20, 2004

(65) Prior Publication Data

US 2005/0023761 A1 Feb. 3, 2005

Related U.S. Application Data

(60) Provisional application No. 60/491,021, filed on Jul. 30, 2003.

(51) Int. Cl.
*A63F 1/00* (2006.01)

(52) U.S. Cl. ..... 273/299; 273/302; 273/292; 434/209

(58) Field of Classification Search ..... 273/292, 273/293, 299, 302–306, 308, 272; 434/209
See application file for complete search history.

(56) References Cited

U.S. PATENT DOCUMENTS 4,807,885 A 2/1989 Chamblee et al.
5,242,171 A 9/1993 Hata
5,380,012 A 1/1995 Jones et al.
5,451,062 A 9/1995 Malone
5,613,682 A 3/1997 Otuzbiryan
5,711,526 A 1/1998 Van Hollebeke
6,102,401 A 8/2000 Segman et al.
6,193,235 B1 2/2001 Vancura et al.
6,234,484 B1 5/2001 Strauss
6,446,973 B1 9/2002 Pham

OTHER PUBLICATIONS

How To Play UNO, (c) 1993 International Games, Inc., http://hometown.aol.com/babso00001/unrules.html.*
UNO Variations, Ronda's rule: Add It Up!, www.pagat.com/invented/uno_vars.html, Feb. 10, 1999, http://web.archives.org.*
UNO—Star Trek Special Edition (1999), www.boardgamegeek.com/game/3806.*

* cited by examiner

*Primary Examiner*—Benjamin Layno
(74) *Attorney, Agent, or Firm*—Leslie Meyer-Leon; IP Legal Strategies Group P.C.

(57) ABSTRACT

The invention features a method of playing a card game using a deck of numbered cards. Each player is dealt a predetermined number of cards, so that each player possesses a card set, or "hand" of cards. The remaining cards form a draw pile, and one card from the draw pile is turned face up to start a separate discard pile. The object of the game is for each player to remove cards from its card set by discarding a card that is either a multiple or a divisor of a card shown on the top of a common discard pile.

17 Claims, 2 Drawing Sheets

CARD GAME

REFERENCE TO PRIOR APPLICATION

This application is based on and claims priority from U.S. Provisional patent application Ser. No. 60/491,021. filed Jul. 30, 2003, which is hereby incorporated by reference.

FIELD OF THE INVENTION

This invention relates to a card game played with a deck of numbered cards.

BACKGROUND OF THE INVENTION

Games are primarily for amusement of adults and children. For those games having more than one participant, the amusement factor is based on a combination of social interaction and the competitive element required to play a game. Because card games are interesting, exciting, and even challenging, they are often able to hold and maintain the attention of players for hours at a time. Beyond simply the pure enjoyment of card games, card games provide an opportunity for people to join together in fun and fellowship. Although many well-known card games are played by great numbers of people today, one finds that many of the card games commercially available today are designed around like and similar concepts. Put simply, many commercially available card games are very much alike and do not provide for stimulating and entertaining gaming. There is and continues to be a need for more exciting, challenging and entertaining card games.

Common card games include poker, hearts, bridge, and rummy. The principle mechanics or method of any game is based on: 1) preliminary general information about the subject of the game and game hardware, including alternative formats or modes of playing the game, and objects, equipment, or media required for playing the game (e.g., cards, dice, chips, tokens, game board, number or object spinner, computer, etc.), required number of players, typical time duration of play; 2) a detailed set of rules and step-by-step procedures specifying a competition, including the permissible actions of and information available to each participant; 3) the criteria for ending the game, typically based on completion of specific tasks, an accumulation of a pre-set number of points, or attainment of a score. Often, game mechanics include information relating to the probabilities with which chance events may occur, since an important property of nearly every game involves the occurrence of chance or random events. A mathematical game indicates that the mechanics is based on utilizing mathematical operations, such as multiplication and/or division of numbers for completing specific tasks.

BRIEF SUMMARY OF THE INVENTION

The invention features a method of playing a card game using a deck of numbered cards. Each player is dealt a predetermined number of cards, so that each player possesses a card set, or "hand" of cards. A discard pile is started by turning at least one of the cards remaining in the deck after the deal face up on the game surface or playing surface as shown in FIG. 2. Each player in turn reviews his hand and selects from it a card having a value that is either a multiple of, or a divisor of, the value shown on the card shown face up on the top of a discard pile. The player places his card face up on the discard pile to completely cover the preceding discard, an action variously referred as 'playing', discarding', or 'throwing' the card on the discard pile. Preferably, the winner of the game is the first player to have no cards remaining in his hand.

The term "multiple" is used herein in its mathematical context to mean a number that contains another number an integral number of times without a remainder. A "divisor," as used herein, is a number that is contained in another given number a certain integral number of times without a remainder.

The card game of the invention provides a card game that is not only entertaining, stimulating, and challenging, but also benefits from strategy and thinking skills. It is a card game and method of playing that is relatively simple to understand, and can be played and enjoyed by people of all ages. The present invention resides in the provision of a card game and method of playing where success depends on a very unique blend of skill, strategy and luck.

Another object of the present invention resides in the provision of a card game and method of playing that is designed and structured around discarding one card at a time from one's hand wherein the cards discarded are multiples or divisors of the previous discard, and wherein discarding is controlled by the availability of cards having the requisite numerical value in the card deck.

Other objects and advantages of the present invention will become apparent and obvious from a study of the following description and the accompanying drawings which are merely illustrative of such invention.

DETAILED DESCRIPTION OF THE INVENTION

The present game through this special mix of numerical cards is designed to reward skill and strategy but at the same time incorporate an appropriate factor of luck that gives the entire game a tremendous amount of appeal for a wide range of players including school aged children, teenagers and adults.

Method of Play

Figure 2:
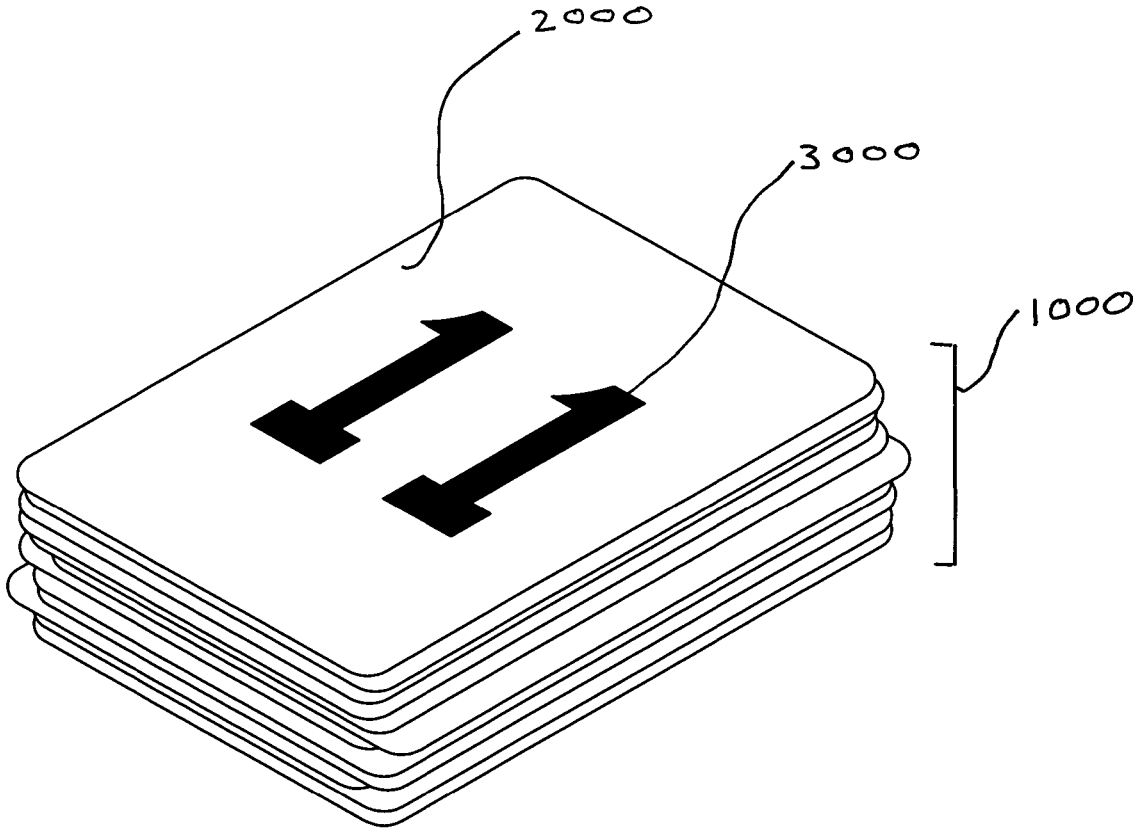
FIG. 2 is an illustration of a deck 1000 of a series of numerical value cards 2000, each numerical value card 2000 exhibiting a given numerical value 3000.

The card game of the invention is played using a deck of numbered cards (FIG. 2). By way of illustration, the deck 1000 includes a series of numerical value cards 2000. The number of times that a card with a given numerical value 3000, or rank, is included in the deck is chosen to optimize the flow and degree of difficulty of the game. By way of example, the deck can include a series of cards having numbers within a range beginning with "1" and ending with "50," but all values within the range need not be represented equally, and in fact some values need not be present in the deck at all.

A dealer shuffles the cards and deals a predetermined number of cards to each player, to form a 'hand' of cards, otherwise referred to as a 'set of cards' or an 'object set.' Preferably, each player is dealt a hand of seven cards. The dealer forms a discard pile by turning one of the remaining cards face up on the play surface as shown in FIG. 2. Optionally, a draw pile can be provided by turning the cards remaining in the deck face down to start a separate draw pile on the play surface.

Upon receipt of its hand, each player examines the cards in its hand without showing its hand to the other players. Any one of the players can be the first to play, and play can proceed in any order of players. By way of example, however, the first player can be the player to the left of the dealer, with play passing to each sequential player to the left, or clockwise. To begin the play, a first player selects from his or her hand a card having a numerical value that is either a multiple of, or a divisor of, the value shown on the top card of the discard pile, and discards it by placing it face up onto the top of the discard pile, thereby completely covering the previously exposed card.

Figure 1:
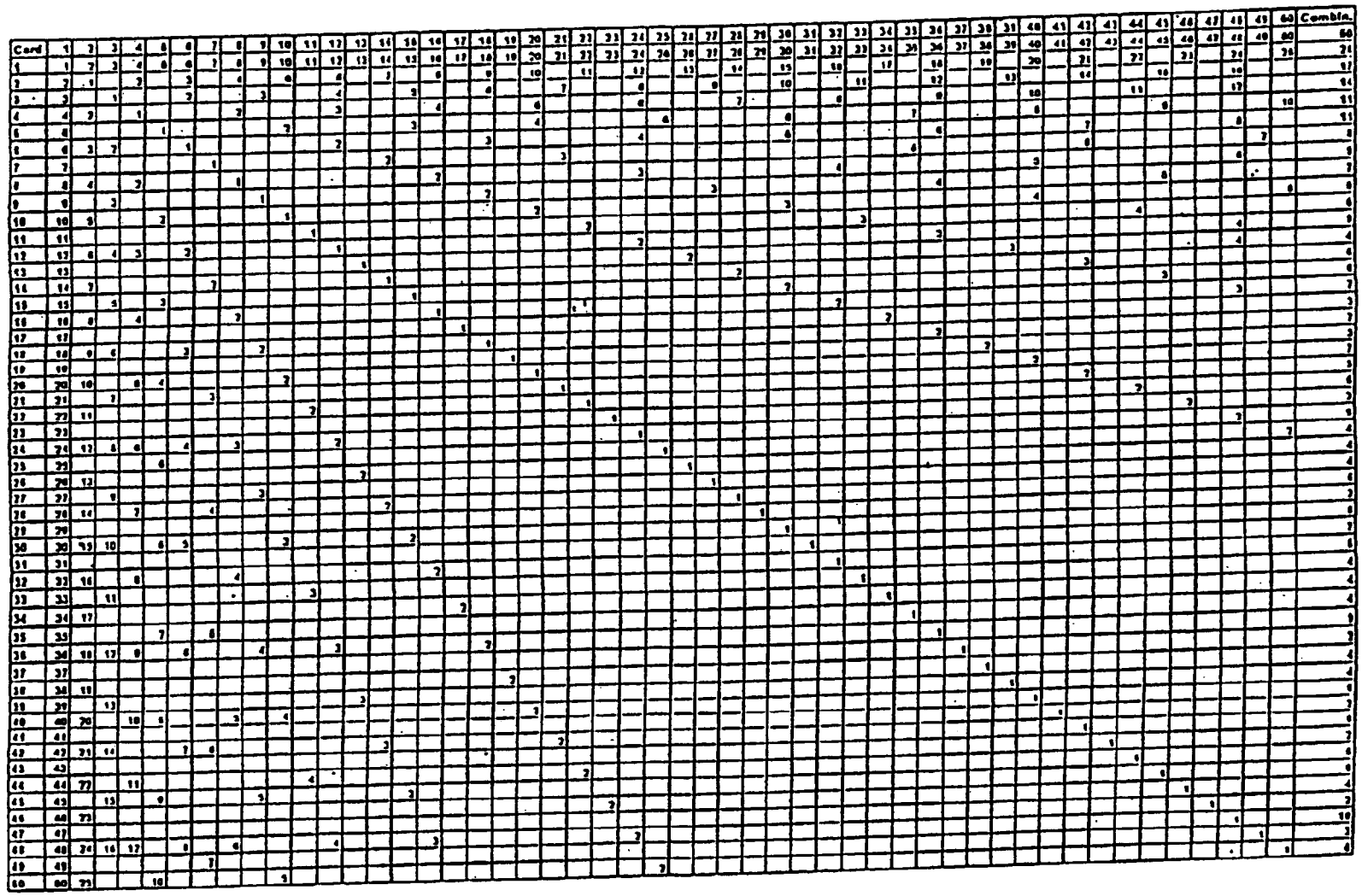
FIG. 1 is a table chart illustrating the number of possible card combinations that can be used to select a card to play when the discard pile shows any value between 1 and 50. The number of options is shown in the right-most column, and is determined from the number of integers that are even multiples or divisors of any one card showing on the top of the discard pile.

FIG. 1 illustrates the number of options available to a player faced with a particular number rank exposed on the top of the discard pile. The number of possibilities for play is determined by the number of possible combinations of integer multipliers and divisors. For example, if the card on top of the discard pile is a 50, the player can choose to play from its hand any card having a value of 1, 2, 5, 10, 25, or 50, each of these values being even divisors of 50. In another example, if the card on the top of the discard pile is an eleven (FIG. 2), the player can play any card having a value of 1, 11, 22, 33, or 44. (It will be understood that the availability of any one of these cards is limited by the frequency that each numerically ranked card is represented in the deck. Where only a single card having a particular numerical value is present in the deck, a player is further restricted. For example, if, as in FIG. 2, an eleven is on the top of the discard pile, and the composition of the deck includes only a single eleven, the player can play only those cards having values of 1, 22, 33, or 44, but can not play another 11. Thus, a player confronting a 50 on the discard pile has six possibilities, while a player confronting an eleven has only five). A player confronting a prime number is limited to discarding a 1, a duplicate of the same prime number (if there is another one in the deck), or a multiple of the prime number; by definition, a player never has the option of discarding a divisor of a prime number.

It will therefore be appreciated that if the card on top of the discard pile is a one, the player can play, or throw, any card in its hand, because every number is divisible by one. Similarly, a player having a one in its hand can play that card on top of any card on the discard pile. Thus, cards having a rank of 'one' can be considered 'wild' cards due to their enhanced flexibility of play.

In the event that a player has no card that is a multiple or divisor of the card face up on the discard pile, and thus has no card available to play, the player takes a card from the draw pile. If the drawn card is either a multiple or divisor of the card on the discard pile, then the player plays the card by discarding it. If the player still cannot play with the drawn card, the player plays no card and play passes to the next player.

When a player eliminates all of its cards in the above manner, that player wins that hand of the game, and if the game is a single hand game, is the winner of the game itself. This is referred to as "going out."

When the draw pile is used up, the last discarded card is set aside to begin a new discard pile and the discard pile is preferably, shuffled and placed face down as a new draw pile.

Alternatively, play can cease when the draw pile is used up. In this case, the winner is determined by another criterion such as, e.g., the player having the lowest cumulative point value in its hand. The point count calculation is determined as the sum of the value for all of each player's respective remaining cards at the end of the hand and are summed up to determine each player's respective point count total for that particular hand. Optionally, the point count totals can be recorded on a score sheet over the course of multiple rounds of hands.

Composition of the Deck of Cards of the Invention

The deck of cards of the invention includes a set of numerical values formulated to optimize the play. Each of the cards in the deck of cards of the invention has a numerical value chosen according to a formula.

In one embodiment of the invention, the card game can be played with a deck of cards having ninety-four cards having numerical ranks between 1 and 50, chosen according to the composition shown in Table 1. The composition of cards shown in Table 1 is calculated according to the "3-Formula" described below, as further modified by eliminating all prime numbers having a rank or value greater than 25.

TABLE 1

| 3-Formula | |
|---|---|
| Face Value of Card | Number of Cards in Deck |
| 1 | 13 |
| 2 | 7 |
| 3 | 4 |
| 4 | 4 |
| 5 | 3 |
| 6 | 3 |
| 7 | 2 |
| 8 | 2 |
| 9 | 2 |
| 10 | 2 |
| 11 | 1 |
| 12 | 2 |
| 13 | 1 |
| 14 | 2 |
| 15 | 2 |
| 16 | 2 |
| 17 | 1 |
| 18 | 2 |
| 19 | 1 |
| 20 | 2 |
| 21 | 1 |
| 22 | 1 |
| 23 | 1 |
| 24 | 2 |
| 25 | 1 |
| 26 | 1 |
| 27 | 1 |
| 28 | 2 |
| 29 | 0 |
| 30 | 2 |
| 31 | 0 |
| 32 | 2 |
| 33 | 1 |
| 34 | 1 |
| 35 | 1 |
| 36 | 2 |
| 37 | 0 |
| 38 | 1 |
| 39 | 1 |

TABLE 1-continued

| 3-Formula | |
|---|---|
| Face Value of Card | Number of Cards in Deck |
| 40 | 2 |
| 41 | 0 |
| 42 | 2 |
| 43 | 0 |
| 44 | 2 |
| 45 | 2 |
| 46 | 1 |
| 47 | 0 |
| 48 | 3 |
| 49 | 1 |
| 50 | 2 |
| CARDS: | 94 |

Formulas for computing the composition of numerical values of the cards in a card deck of the invention are shown in Table 2. For each given card value appearing on the discard pile (Table 2, column 1), there are a number of possible card combinations that can be formed as illustrated in FIG. 1. The number of possibilities is again shown in Table 2, column 2. Also shown in Table 2 are examples of four formulas for designing a composition of playing cards in a deck of cards of the invention. For example, one method of determining the number of each numbered card in the game deck includes dividing the number of possible combinations by a specific factor, and rounding the dividend to the nearest integer. Choice of the factor is based on adjusting the number of cards and composition of cards in the deck, to optimize game flow, difficulty, and speed. Larger decks are preferred when playing with larger numbers of players, such as six or eight or even ten or more players. Smaller decks are preferred for groups of two to four, or even eight players, depending on the length and difficulty of game desired.

TABLE 2

| | | Number Cards of Card Value in Deck, by Formula: | | | |
|---|---|---|---|---|---|
| Card Value | No. of Possible Combinations | /4 rounded all primes | /3 rounded all primes | /4 rounded no primes >25 | /3 rounded no primes >25 |
| 1 | 50 | 13 | 17 | 13 | 17 |
| 2 | 26 | 7 | 9 | 7 | 9 |
| 3 | 17 | 4 | 6 | 4 | 6 |
| 4 | 14 | 4 | 5 | 4 | 5 |
| 5 | 11 | 3 | 4 | 3 | 4 |
| 6 | 11 | 3 | 4 | 3 | 4 |
| 7 | 8 | 2 | 3 | 2 | 3 |
| 8 | 9 | 2 | 3 | 2 | 3 |
| 9 | 7 | 2 | 2 | 2 | 2 |
| 10 | 8 | 2 | 3 | 2 | 3 |
| 11 | 5 | 1 | 2 | 1 | 2 |
| 12 | 9 | 2 | 3 | 2 | 3 |
| 13 | 4 | 1 | 1 | 1 | 1 |
| 14 | 6 | 2 | 2 | 2 | 2 |
| 15 | 6 | 2 | 2 | 2 | 2 |
| 16 | 7 | 2 | 2 | 2 | 2 |
| 17 | 3 | 1 | 1 | 1 | 1 |
| 18 | 7 | 2 | 2 | 2 | 2 |
| 19 | 3 | 1 | 1 | 1 | 1 |
| 20 | 7 | 2 | 2 | 2 | 2 |
| 21 | 5 | 1 | 2 | 1 | 2 |
| 22 | 5 | 1 | 2 | 1 | 2 |
| 23 | 3 | 1 | 1 | 1 | 1 |
| 24 | 9 | 2 | 3 | 2 | 3 |
| 25 | 4 | 1 | 1 | 1 | 1 |
| 26 | 4 | 1 | 1 | 1 | 1 |
| 27 | 4 | 1 | 1 | 1 | 1 |
| 28 | 6 | 2 | 2 | 2 | 2 |
| 29 | 2 | 1 | 1 | 0 | 0 |
| 30 | 8 | 2 | 3 | 2 | 3 |
| 31 | 2 | 1 | 1 | 0 | 0 |
| 32 | 6 | 2 | 2 | 2 | 2 |
| 33 | 4 | 1 | 1 | 1 | 1 |
| 34 | 4 | 1 | 1 | 1 | 1 |
| 35 | 4 | 1 | 1 | 1 | 1 |
| 36 | 9 | 2 | 3 | 2 | 3 |
| 37 | 2 | 1 | 1 | 0 | 0 |
| 38 | 4 | 1 | 1 | 1 | 1 |
| 39 | 4 | 1 | 1 | 1 | 1 |
| 40 | 8 | 2 | 3 | 2 | 3 |
| 41 | 2 | 1 | 1 | 0 | 0 |
| 42 | 8 | 2 | 3 | 2 | 3 |
| 43 | 2 | 1 | 1 | 0 | 0 |
| 44 | 6 | 2 | 2 | 2 | 2 |
| 45 | 6 | 2 | 2 | 2 | 2 |

TABLE 2-continued

| Card Value | No. of Possible Combinations | Number Cards of Card Value in Deck, by Formula: /4 rounded all primes | /3 rounded all primes | /4 rounded no primes >25 | /3 rounded no primes >25 |
|---|---|---|---|---|---|
| 46 | 4 | 1 | 1 | 1 | 1 |
| 47 | 2 | 1 | 1 | 0 | 0 |
| 48 | 10 | 3 | 3 | 3 | 3 |
| 49 | 3 | 1 | 1 | 1 | 1 |
| 50 | 6 | 2 | 2 | 2 | 2 |
| TOTAL CARDS: | | 100 | 123 | 94 | 117 |

For example, the deck composition shown in Table 2, column 3, has 100 cards. The number of each card value is determined by dividing the number of possible multiple/divisor combinations (column 2) by a factor of four and then rounding to the nearest integer. This is referred to as a "/4 Rounded" formula. The deck composition shown in Table 2, column 4, has 123 cards. The number of each card value is determined by dividing the number of possible multiple/divisor combinations (column 2) by a factor of three, and then rounding to the nearest integer. This is referred to as a "/3 Rounded" formula.

According to the present invention, each card has an approximately rectangular shape of 5.1 cm×7.2 cm, but other sizes and shapes may be used for the cards. It is to be noted that like most other game cards, the reverse side of each card included in the card deck has a standard design and color so that the players cannot recognize the figure displayed on the obverse side by seeing the reverse side.

The card game of the invention can be further varied according to the following examples.

EXAMPLE 1

In the deck composition shown in Table 2, column 5, the /4 Rounded formula is modified by removing from the deck all prime numbers having values larger than 25.

EXAMPLE 2

The deck composition shown in Table 2, column 6, is based on the /3 Rounded formula, modified by removing from the deck all cards having a numerical value that is a prime number, preferably a prime number greater than 25. There are, therefore, a total of ninety-four (94) playing cards in the card deck, having the numerical distribution shown in Table 1.

EXAMPLE 3

The card game of the invention can be modified by designating a card rank, or a card event, as a 'skip' card. When a "skip" card is thrown on the discard pile, the next player must skip its turn, with play proceeding to a subsequent player. For example, cards having a numerical value of one can be designated to be skip cards, and when a player discards a one, the next player in the sequence losses its turn.

EXAMPLE 4

The card game of the invention can be modified by designating a card rank, or a card event, as a 'reverse' card. When a "reverse" card is thrown on the discard pile, the direction of play reverses, so that if the direction of play initially proceeded counterclockwise, the direction of play changes to the clockwise direction. Cards having a particular numerical value can be designated 'reverse' cards. Alternatively, an event, such as when a player plays a duplicate card on the discard pile, e.g., plays a 5 on top of a 5, a reverse event is triggered, and the direction of play is reversed.

EXAMPLE 5

In other modifications of the card game of the invention, a player drawing a card from the draw pile can draw one card, or can draw a predetermined number of plurality of cards from the draw pile. Alternatively, a player continues to draw cards until obtaining a card that can be played because it is a multiple or divisor of the card on the discard pile.

EXAMPLE 6

The winner of the game is preferably the first player to exhaust all of the cards in his or her hand. In yet another alternative embodiment, the winner of the game can be determined by adding the value of the cards remaining in each player's hand, the winner being the player with the lowest remaining point value.

EXAMPLE 7

In another embodiment of the card game of the invention, a player having a multiple/divisor card in its hand can still choose to draw a card from the draw pile in lieu of discarding the card from its hand. Here, a player having a card suitable for play does not necessarily have to play that card, but rather can pretend that it does not have a suitable multiple/divisor match, and instead take a card from the draw pile. A reason to do this might occur when the player next in line has only a single card remaining in its hand. Were the present player to throw a "1" card, the next player would win by playing any card, of any rank, on the "1" card.

EXAMPLE 8

In another embodiment, the card game of the invention is played without a draw pile. If the player cannot play from its hand, play passes to the next player. The winner is the player with either the lowest remaining point count, or the lowest remaining number of cards, when the hand is terminated by, e.g., one player eliminating all cards, or no player being able to play.

EXAMPLE 9

Cards can be real objects (e.g., a physical 'card'), or virtual objects (e.g., computer images), and can be either two or three dimensional.

EXAMPLE 10

In yet another embodiment, in the event that a player places a card on the discard pile, and the discarded card does not have a numerical value that is either a multiple of, or a divisor of, the value of the card that had been shown on the top card of the discard pile (hereafter a "non-match"), a penalty can be imposed on that player. By way of example, a player that discards by placing a card with numerical value of three (3) on top the discard pile, when the top card of the discard card had shown a value of 46, or vice versa, would be making a non-match play, because the numbers 3 and 46 are neither multiples or divisors of each other.

Optionally, the penalty is not imposed on the offending player unless one or more of the other players is or becomes aware of the non-match; preferably, the penalty is not imposed on the offending player unless one or more of the other players is or becomes aware of the error before the player subsequent to the player who made the non-match places a card on the discard pile, or, alternatively, before the player subsequent to the player who made the non-match draws a card from the optional draw pile. Examples of suitable penalties include, but are not limited to, (a) requiring the offending player to draw one or more cards, e.g., two or three cards, from, from within, or from the bottom of, the discard pile; (b) requiring the offending player to draw one or more cards, e.g., two or three cards, from the optional draw pile; or (c) requiring that the offending player skip a turn.

What is claimed is:

1. A method for a plurality of players to play a mathematical card game based on multiplication and division of numbers and having a predetermined termination criteria, said method comprising the steps of:

a) providing a deck of cards wherein each of said cards has a numerical value (v) depicted on a face-up side of said card, and wherein a card of value v is present in said deck of cards n times, and $n_v$ is a function of possibilities ($P_v$), where $P_v=Pm_v+Pd_v$, $m_v$ is a multiple of v, $d_v$ is a divisor of v, $Pm_v$ is the number of possibilities for $m_v$, and $Pd_v$ is the number of possibilities for $d_v$;

b) dealing a predetermined number of cards from a deck of numbered cards to each of said players to form a card set for each player, and forming a discard pile by placing at least one of said remaining cards in face up position;

c) allowing one of said plurality of players to place a play card in face up position on said discard pile, each said play card having a numerical value that is a multiple or a divisor of a numerical value shown on the face of the discard pile; and d) repeating step (c) until said termination criteria is attained.

2. The method of claim 1, wherein said termination criteria is that no cards remain in the card set of at least one of said players.

3. The method of claim 1, wherein said dealing step further comprises forming a draw pile comprising the remaining cards in the deck of cards, the draw pile cards face down and separate from said discard pile of cards.

4. The method of claim 3, further comprising the step of allowing one of said players to (i) draw a card from said draw pile of cards and add said drawn card to the card set of said player, (ii) determine whether said card set contains at least one play card, and (iii) if said card set contains at least one play card, then to discard said at least one play card from the card set of said player to the top of said discard pile, at which time said player's turn is ended, or alternatively the player has exhausted all of the cards in the player's hand.

5. The method of claim 4, wherein said termination criteria is elimination of a draw pile.

6. The method of claim 5, wherein said method further comprises the step of adding the numerical values of any remaining cards in each player's card set so as to compute a total remaining point count number for each player, identifying a player having a lower total remaining point count number than the total remaining point count numbers of each of said other players, and declaring a winner as being the player with the lowest total remaining point count number.

7. The method of playing a card game as defined in claim 1, wherein the step of drawing a card from said draw pile of cards includes the step of the player continuing to draw a card from said draw pile of cards until the player can play the drawn card.

8. The method of playing a card game as defined in claim 1, wherein the step of discarding a card from a player's hand to the top of said discard pile triggers the step of passing play onto the next player.

9. The method of claim 1, wherein the step of discarding a play card includes the step of discarding a reverse card that results in the direction of play among the players being reversed.

10. The method of claim 2, wherein the step of discarding includes the step of discarding a skip card which results in loss of a turn for a subsequent player.

11. The method of claim 1, wherein said method further comprises imposing a penalty on one of said players.

12. The method of claim 11, wherein said method further comprises the step of, prior to said imposing said penalty, observing an event in which a player attempts to place a card in face up position on said discard pile that does not have a numerical value that is a multiple or a divisor of a numerical value shown the face of the discard pile.

13. The method of claim 1, wherein said function comprises rounding a dividend obtained by dividing $P_v$ by a numerical factor.

14. The method of claim 13, where said numerical factor is chosen from the group consisting of the integer 3 and the integer 4.

15. The method of claim 1, wherein said numerical value v is not a prime number of greater than 25.

16. A method for a plurality of players to play a mathematical card game based on multiplication and division of numbers and having a predetermined termination criteria, said method comprising the steps of:

a) providing a deck of cards wherein each of said cards has a numerical value (v) depicted on a face-up side of said card, and wherein said deck of cards comprises a plurality of cards, each said card having a numerical value appearing on one side of each card, the distribution of ranks in said deck determined by a formula shown in Table 2 as follows:

| Card Value (v) | No. of Possible Combinations ($P_v$) | /4 rounded all primes | /3 rounded all primes | /4 rounded no primes > 25 | /3 rounded no primes > 25 |
|---|---|---|---|---|---|
| 1 | 50 | 13 | 17 | 13 | 17 |
| 2 | 26 | 7 | 9 | 7 | 9 |
| 3 | 17 | 4 | 6 | 4 | 6 |
| 4 | 14 | 4 | 5 | 4 | 5 |
| 5 | 11 | 3 | 4 | 3 | 4 |
| 6 | 11 | 3 | 4 | 3 | 4 |
| 7 | 8 | 2 | 3 | 2 | 3 |
| 8 | 9 | 2 | 3 | 2 | 3 |
| 9 | 7 | 2 | 2 | 2 | 2 |
| 10 | 8 | 2 | 3 | 2 | 3 |
| 11 | 5 | 1 | 2 | 1 | 2 |
| 12 | 9 | 2 | 3 | 2 | 3 |
| 13 | 4 | 1 | 1 | 1 | 1 |
| 14 | 6 | 2 | 2 | 2 | 2 |
| 15 | 6 | 2 | 2 | 2 | 2 |
| 16 | 7 | 2 | 2 | 2 | 2 |
| 17 | 3 | 1 | 1 | 1 | 1 |
| 18 | 7 | 2 | 2 | 2 | 2 |
| 19 | 3 | 1 | 1 | 1 | 1 |
| 20 | 7 | 2 | 2 | 2 | 2 |
| 21 | 5 | 1 | 2 | 1 | 2 |
| 22 | 5 | 1 | 2 | 1 | 2 |
| 23 | 3 | 1 | 1 | 1 | 1 |
| 24 | 9 | 2 | 3 | 2 | 3 |
| 25 | 4 | 1 | 1 | 1 | 1 |
| 26 | 4 | 1 | 1 | 1 | 1 |
| 27 | 4 | 1 | 1 | 1 | 1 |
| 28 | 6 | 2 | 2 | 2 | 2 |
| 29 | 2 | 1 | 1 | 0 | 0 |
| 30 | 8 | 2 | 3 | 2 | 3 |
| 31 | 2 | 1 | 1 | 0 | 0 |
| 32 | 6 | 2 | 2 | 2 | 2 |
| 33 | 4 | 1 | 1 | 1 | 1 |
| 34 | 4 | 1 | 1 | 1 | 1 |
| 35 | 4 | 1 | 1 | 1 | 1 |
| 36 | 9 | 2 | 3 | 2 | 3 |
| 37 | 2 | 1 | 1 | 0 | 0 |
| 38 | 4 | 1 | 1 | 1 | 1 |
| 39 | 4 | 1 | 1 | 1 | 1 |
| 40 | 8 | 2 | 3 | 2 | 3 |
| 41 | 2 | 1 | 1 | 0 | 0 |
| 42 | 8 | 2 | 3 | 2 | 3 |
| 43 | 2 | 1 | 1 | 0 | 0 |
| 44 | 6 | 2 | 2 | 2 | 2 |
| 45 | 6 | 2 | 2 | 2 | 2 |
| 46 | 4 | 1 | 1 | 1 | 1 |
| 47 | 2 | 1 | 1 | 0 | 0 |
| 48 | 10 | 3 | 3 | 3 | 3 |
| 49 | 3 | 1 | 1 | 1 | 1 |
| 50 | 6 | 2 | 2 | 2 | 2 |

b) dealing a predetermined number of cards from a deck of numbered cards to each of said players to form a card set for each player, and forming a discard pile by placing at least one of said remaining cards in face up position;

c) allowing one of said plurality of players to place a play card in face up position on said discard pile, each said play card having a numerical value that is a multiple or a divisor of a numerical value shown on the face of the discard pile; and d) repeating step (c) until said termination criteria is attained.

17. The method of claim 16, wherein said deck of cards has the distribution of numerical values shown in Table 1 as follows:

| Face Value of Card (v) | Number of Cards of value v in Deck ($n_v$) |
|---|---|
| 1 | 13 |
| 2 | 7 |
| 3 | 4 |
| 4 | 4 |
| 5 | 3 |
| 6 | 3 |
| 7 | 2 |
| 8 | 2 |
| 9 | 2 |
| 10 | 2 |
| 11 | 1 |
| 12 | 2 |
| 13 | 1 |
| 14 | 2 |
| 15 | 2 |
| 16 | 2 |
| 17 | 1 |
| 18 | 2 |
| 19 | 1 |
| 20 | 2 |
| 21 | 1 |
| 22 | 1 |
| 23 | 1 |
| 24 | 2 |
| 25 | 1 |
| 26 | 1 |
| 27 | 1 |
| 28 | 2 |
| 29 | 0 |
| 30 | 2 |
| 31 | 0 |
| 32 | 2 |
| 33 | 1 |
| 34 | 1 |
| 35 | 1 |
| 36 | 2 |
| 37 | 0 |
| 38 | 1 |
| 39 | 1 |
| 40 | 2 |
| 41 | 0 |
| 42 | 2 |
| 43 | 0 |
| 44 | 2 |
| 45 | 2 |
| 46 | 1 |
| 47 | 0 |
| 48 | 3 |
| 49 | 1 |
| 50 | 2. |

* * * * *